US006719617B2

(12) United States Patent
Lo et al.

(10) Patent No.: US 6,719,617 B2
(45) Date of Patent: Apr. 13, 2004

(54) SLURRY HOMOGENIZER AND SUPPLY SYSTEM

(75) Inventors: Tun-Yuan Lo, Jungli (TW); Chih-Pin Hsu, Taoyuan (TW); Chih-Kun Chen, Taoyuan (TW)

(73) Assignee: Nanya Technology Corporation, Taoyuan (TW)

( * ) Notice: Subject to any disclaimer, the term of this patent is extended or adjusted under 35 U.S.C. 154(b) by 0 days.

(21) Appl. No.: 10/348,696

(22) Filed: Jan. 22, 2003

(65) Prior Publication Data

US 2003/0207656 A1 Nov. 6, 2003

(30) Foreign Application Priority Data

May 3, 2002 (TW) ..... 91206221 U

(51) Int. Cl.[7] ..... B24B 1/00

(52) U.S. Cl. ..... 451/60; 451/28; 451/36; 451/446

(58) Field of Search ..... 451/60, 28, 36, 451/446; 125/16.02

(56) References Cited

U.S. PATENT DOCUMENTS 6,006,738 A * 12/1999 Itoh et al. ..... 125/21
6,238,279 B1 * 5/2001 Shau et al. ..... 451/446
6,257,955 B1 * 7/2001 Springer et al. ..... 451/7
6,257,965 B1 * 7/2001 Kamikubo et al. ..... 451/60
6,287,192 B1 * 9/2001 Kim et al. ..... 451/60
6,306,020 B1 * 10/2001 Hed et al. ..... 451/60
6,358,125 B2 * 3/2002 Kawashima et al. ..... 451/60
6,402,599 B1 * 6/2002 Crevasse et al. ..... 451/87
6,406,364 B1 * 6/2002 Kimura et al. ..... 451/446
6,447,375 B2 * 9/2002 Yancey et al. ..... 451/60
6,475,071 B1 * 11/2002 Joslyn ..... 451/60
6,547,652 B1 * 4/2003 Roy ..... 451/285
6,565,422 B1 * 5/2003 Homma et al. ..... 451/67

* cited by examiner

*Primary Examiner*—George Nguyen
(74) *Attorney, Agent, or Firm*—Quintero Law Office

(57) ABSTRACT

A slurry homogenizer. A frame having an outlet is disposed on a driving means having a rotating shaft. A waterproof plate having a first opening is disposed in the frame and on the driving means. Part of the shaft penetrates the first opening. A filter is disposed in the frame and on the plate. A first grinding pad has a second opening and is fitted on the shaft through the second opening. The first grinding pad is disposed in the frame and above the plate. A knob is fitted on the top of the shaft. The knob fixes the first grinding pad on the shaft. A cover having a pipe is disposed on the frame. A second grinding pad having a third opening is fitted on the pipe and disposed in the frame. The second grinding pad and the first grinding pad are separated by a fixed distance.

19 Claims, 3 Drawing Sheets

SLURRY HOMOGENIZER AND SUPPLY SYSTEM

BACKGROUND OF THE INVENTION

1. Field of the Invention

The present invention relates to an apparatus for chemical mechanical polishing (CMP), and more particularly, to a slurry supply system having an homogenizer for distributing homogenized slurry.

2. Description of the Related Art

Unevenness of wafer surface is a serious problem, due to the high-integration and multiple layer structure of circuit supplying semiconductor devices. Therefore, in order to planarize or flatten uneven wafer surface, chemical-mechanical polishing (CMP) techniques are commonly used.

Removal rates and uniformity are important criteria for effective CMP technology. Variables such as processing conditions of the CMP equipment, the types of slurry and carriers, and others, greatly affect both removal rate and uniformity. The pH of the slurry and its ion concentration also have an impact on the planarization process.

In general, lumps of slurry sometimes occur when slurry is stored in a tank, greatly affecting the quality of the slurry, thereby causing scratches on wafers and decreasing manufacturing yield.

Conventionally, slurry is homogenized by a stirring and circulation apparatus; however, it is difficult and ineffective to homogenize the slurry with this conventional method.

SUMMARY OF THE INVENTION

An object of the present invention is to provide a slurry homogenizer.

Another object of the present invention is to provide a slurry supply system using the slurry homogenizer, which prevents the lumped slurry from entering the CMP equipment as much as possible.

In order to achieve these objects, the present invention provides a slurry homogenizer. A frame having an outlet is disposed on a driving means having a rotating shaft. A waterproof plate having a first opening is disposed in the frame and on the driving means. Part of the rotating shaft penetrates the first opening. A filter is disposed in the frame and on the waterproof plate. A first grinding pad has a second opening and is fitted on the rotating shaft through the second opening. The first grinding pad is disposed in the frame and above the waterproof plate. A knob is fitted on the top of the rotating shaft. The knob fixes the first grinding pad on the rotating shaft. A cover having a pipe is disposed on the frame. A second grinding pad having a third opening is fitted on the pipe and disposed in the frame. The second grinding pad and the first grinding pad are separated by a fixed distance.

The present invention improves on the prior art in that the slurry supply system uses the slurry homogenizer. Thus, the present invention can thoroughly break and mill the slurry lumps, thereby homogenizing the slurry, improving uniformity and manufacturing yield.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

Figure 1:
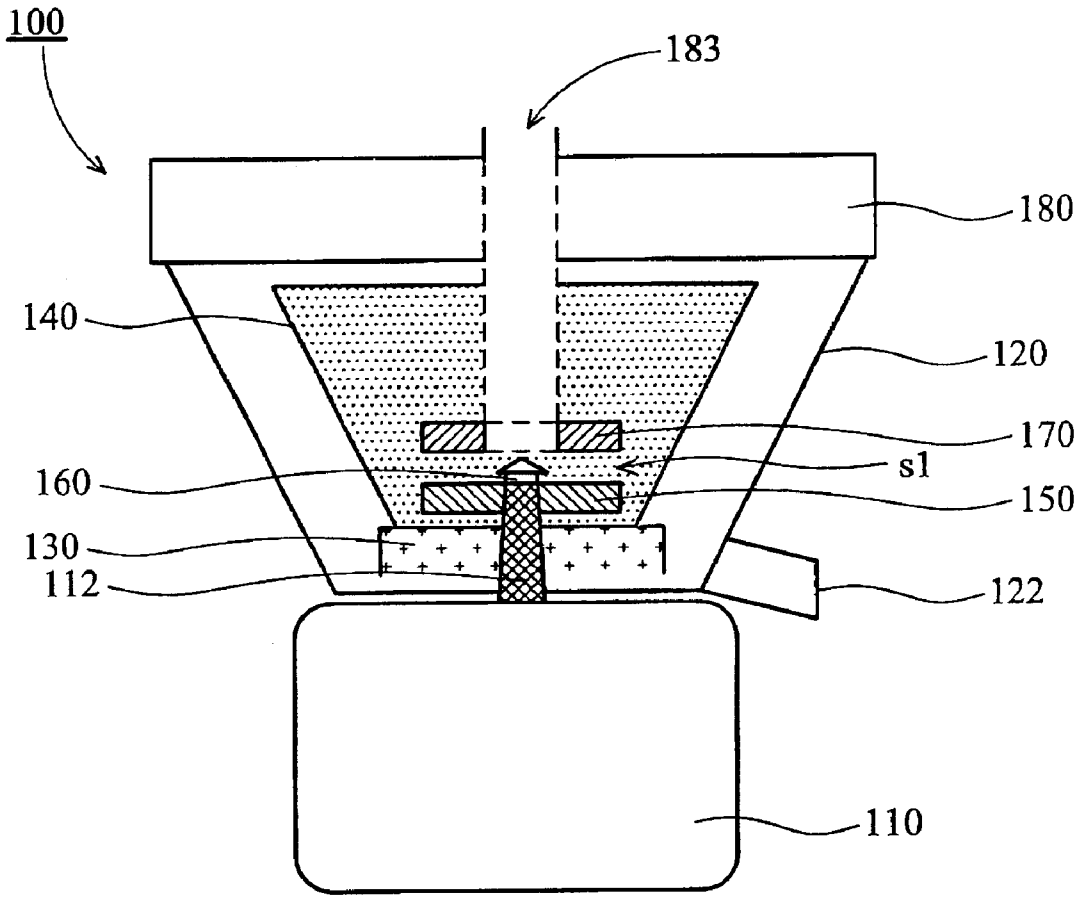
FIG. 1 is a sectional view of the slurry homogenizer according to the present invention.
Figure 2:
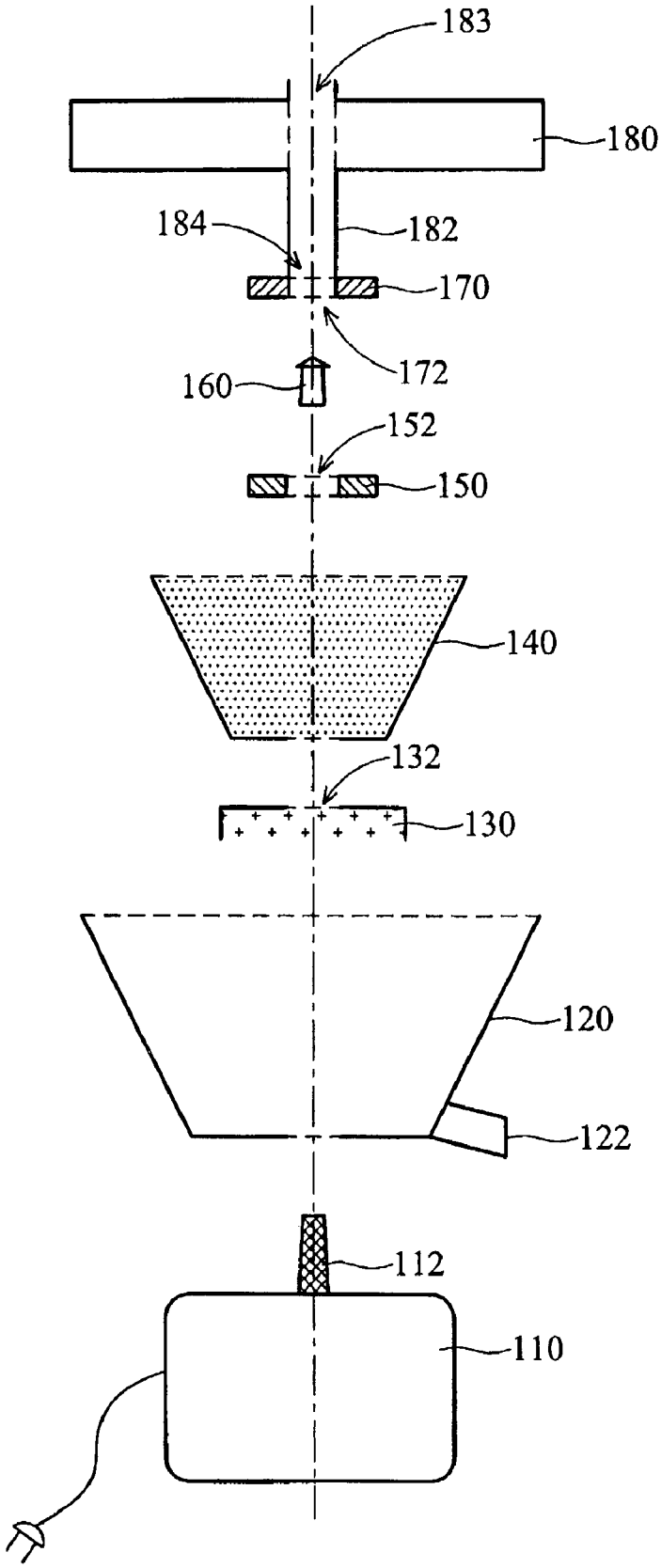
FIG. 2 is an analytic view of the slurry homogenizer according to the present invention.

A slurry homogenizer of the embodiment is shown with reference to FIGS. 1~2. FIG. 1 is a sectional view of the slurry homogenizer of the present invention. FIG. 2 is an analytic view of the slurry homogenizer of the present invention.

In FIGS. 1~2, the slurry homogenizer 100 for homogenizing slurry is provided. The slurry homogenizer 100 generally includes a driving means 110, a frame 120, a waterproof plate 130, a filter 140, a first grinding pad 150, a knob 160, a second grinding pad 170 and a cover 180.

In this embodiment, the driving means 110, such as a motor, has a rotating shaft 112. When the driving means 110 is started, the rotating shaft 112 begins to rotate. The rotation rate of the rotating shaft 112 is preferably controlled at 1000~20000 rpm.

The frame 120 having an outlet 122 is disposed on the driving means 110. The frame 120 can be plastic.

The waterproof plate 130 is disposed in the frame 120 and on the driving means 110. The waterproof plate 130 has a first opening 132, and part of the rotating shaft 112 penetrates the first opening 132. The waterproof plate 130 can be plastic. The waterproof plate 130 protects the rotating shaft 112 from contamination by the slurry.

The filter 140 is disposed in the frame 120 and on the waterproof plate 130. The filter 140 can be steel. The filter 140 ensures that only homogenized slurry passes.

The first grinding pad 150 has a second opening 152 and is fitted on the rotating shaft 112 by means of the second opening 152. The first grinding pad 150 is disposed in the filter 140 and above the waterproof plate 130. The first grinding pad 150 can be steel, such as stainless 316L. Moreover, the surface of the first grinding pad 150 is rough. For example, the surface of the first grinding pad 150 can have stripes or granular structures.

The knob 160 is fitted on the top end of the rotating shaft 112. The knob 160 fixes the first grinding pad 150 on the rotating shaft 112, so that the first grinding pad 150 rotates with the rotating shaft 112.

The cover 180 having a central pipe 182 is disposed on the frame 120. The pipe 182 has an inlet 183 and an outlet 184. The inlet 183 serves as the inlet for slurry. The cover 180 can be plastic.

The second grinding pad 170 having a third opening 172 is fitted on the pipe 182 at the outlet 184 by means of the third opening 172. The second grinding pad 170 is disposed in the filter 140. The second grinding pad 170 can be steel, such as stainless 316L. The surface of the second grinding pad 170 is rough, having, for example, a surface comprising stripes or granular structures.

It is important to note that there is a slit s1 between the second grinding pad 170 and the first grinding pad 150. The slurry flows into the slit s1 and is then homogenized by the grinding pads 150, 170. The pitch of the slit s1 is preferably 1~10 mm.

Here, an operational example of the slurry homogenizer 100 is provided. Please refer to FIG. 1. After starting the driving means 110, the first grinding pad 150 is rotated with the rotating shaft 112. Then, the slurry is introduced from the inlet 183 and flows into the slit s1 between the first grinding pad 150 and the second grinding pad 170. Meanwhile, the lumps in the slurry are broken and milled so that the slurry is homogenized. Then, the homogenized slurry is filtered through the filter 140 and drains away from the outlet 122.

As an application of the present invention, the slurry homogenizer 100 of the present invention can be applied to a slurry supply system for supplying slurry to CMP equipment.

Figure 3:
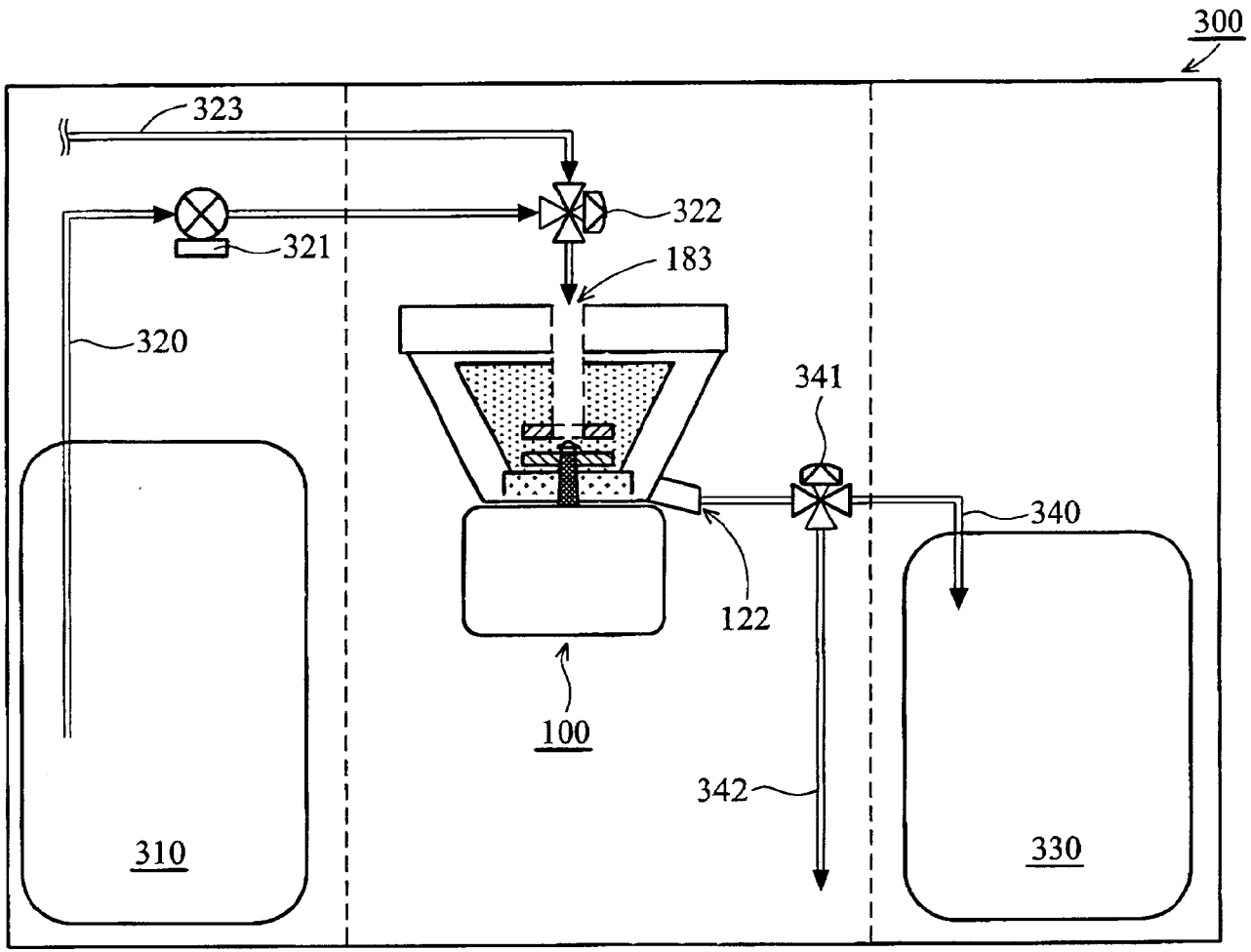
FIG. 3 is a schematic view illustrating the slurry homogenizer applied to a slurry supply system according to the present invention.

In FIG. 3, the slurry supply system 300 generally includes a slurry tank 310, the slurry homogenizer 100, a first pipe 320, a slurry distribution means 330 and a second pipe 340.

The slurry tank 310 is used to store the slurry. The slurry homogenizer 100 homogenizes the slurry. The first pipe 320 connects the slurry tank 310 to the inlet 183 of the slurry homogenizer 100, where the first pipe 320 delivers the slurry from the slurry tank 310 to the slurry homogenizer 100. Moreover, a pump 321 and a first control valve 322 are disposed in line with the first pipe 320. In addition, the first control valve 322 can also connect a pure water pipe 323.

The slurry distribution means 330 stirs and distributes the slurry homogenized by the homogenizer 100. The second pipe 340 connects the slurry distribution means 330 to the outlet 122 of the homogenizer 100, where the second pipe 340 delivers the homogenized slurry from the slurry homogenizer 100 to the slurry distribution means 330. Moreover, a second control valve 341 is disposed in line with the second pipe 340. In addition, the second control valve 341 can connect a drainpipe 342.

In the manner described, the slurry homogenizer 100 of the present invention can be deployed separately or applied to the slurry supply system. Thus, the present invention thoroughly breaks and mills the slurry lumps, thereby homogenizing the slurry, improving uniformity for CMP and ameliorating the disadvantages of the prior art.

Finally, while the invention has been described by way of example and in terms of the above, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A slurry homogenizer, comprising:

a driving means having a rotating shaft;

a frame disposed on the driving means, wherein the frame has an outlet;

a waterproof plate disposed in the frame and on the driving means, wherein the waterproof plate has a first opening, and part of the rotating shaft penetrates the first opening;

a filter disposed in the frame and on the waterproof plate;

a first grinding pad having a second opening and fitted on the rotating shaft by means of the second opening, wherein the first grinding pad is disposed in the frame and above the waterproof plate;

a knob fitted on the top end of the rotating shaft, the knob fixing the first grinding pad on the rotating shaft;

a cover disposed on the frame, wherein the cover has a pipe; and a second grinding pad having a third opening and fitted on the pipe, wherein the second grinding pad is disposed in the frame, and the second grinding pad is spaced from the first grinding pad by a distance.

2. The slurry homogenizer according to claim 1, wherein the driving means is a motor.

3. The slurry homogenizer according to claim 1, wherein the frame is plastic.

4. The slurry homogenizer according to claim 1, wherein the waterproof plate is plastic.

5. The slurry homogenizer according to claim 1, wherein the filter is steel.

6. The slurry homogenizer according to claim 1, wherein the first grinding pad is steel.

7. The slurry homogenizer according to claim 1, wherein a surface of the first grinding pad is rough.

8. The slurry homogenizer according to claim 1, wherein the second grinding pad is steel.

9. The slurry homogenizer according to claim 1, wherein a surface of the second grinding pad is rough.

10. The slurry homogenizer according to claim 2, wherein the cover is plastic.

11. A slurry supply system for supplying slurry to CMP equipment, comprising:

a tank for storing the slurry;

a homogenizer for homogenizing the slurry, wherein the homogenizer comprises:

a driving means having a rotating shaft;

a frame disposed on the driving means, the frame having an outlet;

a waterproof plate disposed in the frame and on the driving means, wherein the waterproof plate has a first opening, and part of the rotating shaft penetrates the first opening;

a filter disposed in the frame and on the waterproof plate;

a first grinding pad having a second opening and fitted on the rotating shaft by means of the second opening, wherein the first grinding pad is disposed in the frame and above the waterproof plate;

a knob fitted on the top end of the rotating shaft, the knob fixing the first grinding pad on the rotating shaft;

a cover disposed on the frame, wherein the cover has a pipe; and a second grinding pad having a third opening and fitted on the pipe, wherein the second grinding pad is disposed in the frame, and the second grinding pad is spaced from the first grinding pad by a distance;

a first pipe connecting the tank to the homogenizer, wherein the first pipe delivers the slurry from the tank to the homogenizer;

a slurry distribution means for stirring and distributing the slurry homogenized by the homogenizer; and a second pipe connecting the slurry distribution means to the homogenizer, wherein the second pipe delivers the slurry homogenized by the homogenizer to the slurry distribution means.

12. The slurry supply system according to claim 11, wherein the driving means is a motor.

13. The slurry supply system according to claim 11, wherein the frame is plastic.

14. The slurry supply system according to claim 11, wherein the waterproof plate is plastic.

15. The slurry supply system according to claim 11, wherein the filter is steel.

16. The slurry supply system according to claim 11, wherein the first grinding pad is steel.

17. The slurry supply system according to claim 11, wherein a surface of the first grinding pad is rough.

18. The slurry supply system according to claim 11, wherein the second grinding pad is steel.

19. The slurry supply system according to claim 11, wherein a surface of the second grinding pad is rough.

* * * * *